US008281465B1

(12) United States Patent
Miraldi

(10) Patent No.: US 8,281,465 B1
(45) Date of Patent: Oct. 9, 2012

(54) ADAPTABLE/ADJUSTABLE JEWELRY CONTAINER

(76) Inventor: Gary Miraldi, West Haven, CT (US)

( * ) Notice: Subject to any disclaimer, the term of this patent is extended or adjusted under 35 U.S.C. 154(b) by 105 days.

(21) Appl. No.: 12/800,985

(22) Filed: May 26, 2010

Related U.S. Application Data

(60) Provisional application No. 61/217,326, filed on May 29, 2009.

(51) Int. Cl.
*A61G 17/00* (2006.01)

(52) U.S. Cl. ..... 27/1; 63/1.14

(58) Field of Classification Search ..... 27/1; D99/5; 63/1.14–1.15; 206/496, 37, 530; 220/359.1, 220/801, 916
See application file for complete search history.

(56) References Cited

U.S. PATENT DOCUMENTS

| | | | | | |
|---|---|---|---|---|---|
| 681,627 | A * | 8/1901 | Cutting | 220/801 |
| 1,861,570 | A * | 6/1932 | Hopkins | 220/801 |
| 2,091,877 | A * | 8/1937 | O'Nell | 220/265 |
| 3,567,085 | A * | 3/1971 | Flores | 224/604 |
| 4,166,537 | A * | 9/1979 | Fortunato | 206/535 |
| 4,420,076 | A * | 12/1983 | Beveridge et al. | 206/37 |
| 5,158,174 | A | 10/1992 | Hereford | |
| 5,208,957 | A | 5/1993 | Hereford | |
| 5,755,116 | A | 5/1998 | Sparacino et al. | |
| 5,987,720 | A * | 11/1999 | Yamamoto | 27/35 |
| 6,971,513 | B2 * | 12/2005 | Weinstein et al. | 206/321 |
| 7,467,444 | B1 * | 12/2008 | Johnson, Sr. | 27/1 |
| 7,950,117 | B2 * | 5/2011 | Elhaj | 27/1 |
| 8,046,881 | B2 * | 11/2011 | Johnson et al. | 27/1 |
| 2003/0024089 | A1 * | 2/2003 | Dziekonski | 27/1 |
| 2003/0182963 | A1 * | 10/2003 | Beatty | 63/1.14 |
| 2005/0081561 | A1 * | 4/2005 | Eggleston | 63/21 |
| 2009/0266108 | A1 * | 10/2009 | Balme et al. | 63/1.11 |

* cited by examiner

*Primary Examiner* — William L. Miller

(57) ABSTRACT

A three part adaptable/adjustable jewelry container is presented for saving and preserving a small sample of ashes or other form of DNA material from either human or animals. The container may vary in size and shape to modify and enhance another separate piece of jewelry and may be attached by means of soldering the container, once completed, to the front, back, top, bottom or sides of the charm, bracelet, necklace, or ring, or other style of jewelry accompanying the container. The container can also be adjusted in height which will reduce the cavity where the ashes or DNA are kept, before the bottom cap is secured, to provide an air and water tight seal to insure the safety and integrity of the enclosed material. This will allow the completed container to accent and blend better with its other jewelry component, or in the case of standing alone as an independent piece of jewelry, the ability to lay flatter to the wearer.

15 Claims, 4 Drawing Sheets

ADAPTABLE/ADJUSTABLE JEWELRY CONTAINER

CROSS REFERENCE TO RELATED APPLICATIONS

Reference is made to and priority is claimed from U.S. Provisional Patent Application Ser. No. 61/217,326 filed May 29, 2009 the disclosure and contents of which are incorporated herein by reference.

FIELD OF THE INVENTION

The present invention relates generally to jewelry and more specifically to jewelry containers and in particular to an adaptable/adjustable jewelry container for cremation ashes, DNA material, soil and like substances and materials.

BACKGROUND

Jewelry cremation containers are disclosed for example in U.S. Pat. Nos. 5,158,174 and 5,208,957 to Hereford and U.S. Pat. No. 5,755,116 to Sparacino. Hereford discloses a cremation jewelry container with a minor container and a major container to be combined to create a pendant which could hold multiple samples for example from different donors. The minor container in Hereford is described and illustrated as a cylinder tube which is closed at its bottom with an open cavity to allow cremated ashes to be placed inside, before being closed by a cap which possesses a flat surface which exceeds the outer circumference of the minor tube and is basically illustrated in FIG. 3 as a bigger sleeve cylinder section (20), with a smaller sleeve and cap (40), which fits into the larger cylinder (20). The cap is larger than the inside dimension of its companion sleeve or tubing. The major container is described as decorative, in pendant style, which will act as a housing unit for singular or multiple minor containers. Hereford provides a piece of jewelry with a singular purpose, which is to hold minor containers. Although stylish, it requires both containers to complete the Hereford's intended desire to secure the cremated ashes in a fashionable apparatus. The minor container does not seem to have an identity independent of the major container.

Sparacino discloses that two similarly sized and dimensioned cylinder or flange designed components will comprise its cremation container. They will slip over each other to form the completed container. It will be threaded or the use of a silicone sealant will secure ashes or other material within its cavity. The cavity compartment will permit the deposit of multiple samples, such as cremated ashes, a lock of hair, or tooth, as a few illustrations of deposits separately housed with the container. Sparacino also describes placing said container within another hollowed out piece of jewelry, with two reflective matching parts; such as but certainly not limited to a locket device commonly seen in the jewelry industry, or some other style piece with two halves. The completed container can then be placed and hidden within said piece and sealed together with silicone sealant. Sparacino also describes the use of decorative marking, jewels, and etched information being placed on the front and back covers to enhance the commemorative value of the container to the user The present invention differs from both Hereford and Sparacino on many different levels. One of the differences is both the Hereford and Sparacino containers are designed to hold multiple samples. In contrast the present invention possesses a singular chamber 8 for use in holding a definitive sample as described herein. Multiple samples could only occur by incorporating multiple containers or contaminating the cavity with multiple items for deposit. Therefore for a woman who may have lost her husband, and child and got married on the beach in St. Thomas; she would have to place each sample of corresponding material into its own container. Then each container could be soldered behind a specific independent piece of jewelry, or in the case of a written charm, placed top, bottom and sides, either in a row or scattered about the piece.

In one example, the adaptable/adjustable jewelry container embodying the present invention is configured to function as an independent piece of jewelry as shown for example in FIG. 5A, FIG. 5B and FIG. 5C, to provide the possibility of different and distinct samples sharing the same environment, such as but not limited to, a charm bracelet or necklace will allow for the adaptable jewelry containers to be present in the same general area. In another example, the present invention is configured as giftware to provide separate but multiple containers that may share the same frame as shown for example in FIG. 10, plaque plate FIG. 11 or other forms of giftware, by drilling additional holes or receptacles for the containers to then be secured with an appropriate form of adhesive.

A further difference between the Hereford and Sparacino is in the ability of the present invention to adapt and accent another independent piece of jewelry or giftware, while still remaining visible to the eye, and not compromising the aesthetic design intended by the original piece of jewelry FIG. 4A, FIG. 4B, FIG. 4C. This is accomplished on multiple levels within the design of the present invention, and particularly in its ability to change its shape and size, as well as the total depth of the jewelry container, while maintaining its principles of design, makes it possible to fit into, on top of or alongside of, almost any piece of jewelry or giftware item FIG. 9. The adaptable jewelry container can also mimic the design of the original item, such as but not limited to, diamond cutting the top or bottom caps, or adding a single or multiple diamonds. It can also be accented with colored stones and engraving of symbols, initials, hearts, crosses or some other ornamental design to enhance the original design. Although Sparacino makes reference to the possible use of etched information, and jewels and decorative markings to enhance the commemorative value of its container, the container's explicit design is to be concealed within another piece of jewelry which makes it symbolic and not ornamental. Both Hereford and Sparacino keep the container holding the ashes hidden and do not accent or enhance the designs in which they are being placed.

A yet further difference between both the Hereford and Sparacino containers and the present invention for an adaptable and adjustable design for holding the cremated ashes of animals, humans, or other species, as well as the possibilities of different forms of soil/sand in an airtight container, is in its basic design. Hereford and Sparacino both rely on the concept of a cylindrical bottom with its cap already in place. The top in the Sparacino design uses a similar sized top flange or cylinder to be secured with silicone. Hereford uses a larger flat plate on a tube or cork, which then slips into the opening of its bottom minor container counterpart. In contrast, when the present invention takes its shape, such as but not limited to, oval, pear, marquise, star or square, the bottom of the present invention's base is open with thicker walls than its top, to allow for any minor adjustments in height and cavity size to conform and accent another item. The top cap 14 and bottom cap 16 are solid in the present invention, and have no tubing attached to assist in effectively closing the containers chamber, as both the Hereford and Sparacino designs incorporate. The present invention instead uses a design bezel recessed top base 12 and a solid top cap 14 with a slight tapering 15 from its top surface to bottom surface, which is arranged to sink down and rest snugly to the larger opening. The solid top cap 14 is also arranged to rest on the ledge 7 created by the making of the bezel. The bottom cap 16 is also solid, but smaller than the top to seal narrower opening at bottom of base 12. Each end cap, depending on the material in which it is made, may be sealed by any suitable means, such as, for example, laser or conventional soldering, or generous use of a suitable adhesive to carry out the intended function.

Another difference between the containers disclosed by Hereford and Sparacino and the present invention, is that with simple modifications, while keeping true to the initial designs concept, the adaptable jewelry container may be configured to function as an independent piece of jewelry FIG. 5A, FIG. 5B, FIG. 5C, FIG. 6 and FIG. 7, will be accomplished for example, with the addition of a loop or loops being placed on the base part of container. When one loop is added to the center of the base, FIG. 5A, FIG. 5B, FIG. 5C, FIG. 7, it will require either a bale or jump ring, so that the container can swing freely on a chain or bracelet. When adding multiple loops, such as in three, FIG. 6 but not limited to these restrictions or numbers, the adaptable jewelry container will replace the junction between the two strands of beads and the beads and cross in a set of rosary beads. The top cap can then be made ornamental with engraving, addition of diamonds or genuine or synthetic stones, or by using a standard size religious charm to replace the top cap, which will fit at top of bezel base and act as a substitute for sealing the top of the container. Neither Hereford nor Sparacino possess this capability. Both Hereford and Sparacino require some outside device to encase either their minor container as disclosed in Hereford or major container as disclosed in Sparacino which then transforms the major or minor container into a co-dependent piece of jewelry.

A further difference between the present invention for a jewelry container which can secure the cremated ashes or DNA or earthly material within its chamber, is its ability to be manufactured in materials other than those mentioned in either Hereford or Sparacino. The Hereford and Sparacino containers are limited in their claims to the field of metals, and would not be practical or in some cases possible to produce in other materials. In the case of the Hereford design, the minor container would pose a problem, as its cap has to be soldered, while its major container, after inserting the minor container, might be possibly sealed with silicone, as soldering is not an option in either plastics or wood. Sparacino calls for two threaded or overlapping two part flange or cylinders. Although this might be possible in plastics, but not disclosed, it still falls short of a successful design, when having to be encased within another two separate piece hollowed design, with only the use of silicone to secure and align all three pieces. The three pieces previously mentioned would be the completed container and two separate outer designs mentioned. Therefore the containers in Hereford and Sparacino could not be produced in woods and plastics. This present invention for an adaptable jewelry container, works with the same design functions regardless of the material from which it is ultimately produced and still retains its ability to adjust its height before sealing cremated ashes, DNA or other mentioned materials, by means of adjusting the bottom of the base before sealing with the bottom end cap

SUMMARY

A jewelry container, which can store inside a single chamber the cremated ashes or DNA of animals, humans, and any other species known to man is disclosed. There could also be the possibility of placing soil or sand within its cavity. This invention will provide an airtight container which could adapt itself to another object or piece of jewelry. Accenting and enhancing the original piece, while proving a safe environment for the contents. Altering its shape and sizes allows for the adaptable/adjustable jewelry container to blend or hide behind separate jewelry items used as its compliment. It will also function in different shapes and sizes, as an independent piece of jewelry in its own right FIG. 5A, FIG. 5B, FIG. 5C and FIG. 7. It will also be featured in its own line of designs, with the bottom cap and bottom base pre-molded to each piece designed, examples being but not limited to, crosses FIG. 8A, hearts FIG. 8B, stars FIG. 8C, religious symbols and animals. The adaptable jewelry container will be manufactured in various materials to provide a cost which can be comfortable to all markets and users.

The common bond between all these samples is that they all represent the sentimental entities which inspire thoughts of love and comfort to the user. Having a special moment or thought represented by a unique piece of jewelry has been a custom pasted down through many generations. Having a grandmother's charm, ring or bracelet given to the first born girl in the family was established centuries ago and still practiced to this current time. The need for a physical connection to the people, pets and memories that hold significance in our lives, has in many instances, been represented through furniture, pictures and jewelry, and gives a sense of connection to one's past and a positive feeling of transferring these special moments to future generations. This invention's ability to be added to a special charm, bracelet, necklace, pendant, ring, money clip, or key ring, owned by the user, ties the past to the future. This capability provides a means of securing the cremated ashes or other material, in a manner and versatility not previously disclosed or known hereto.

An adaptable/adjustable jewelry container to secure the remembrance of cremated ashes or DNA of any species, or a sample of dirt or sand in a single airtight chamber is disclosed. The unique attributes of this invention, is in its ability to be added to and accent or enhance almost any secondary piece of jewelry, such as but not limited to, written charms FIG. 4A, regular open back charms FIG. 4C and pendants FIG. 4B, and money clips. A slight modification, by means of a strategically placed jump rings or loops 11, allows it to act as an independent container FIG. 5A, FIG. 5B, FIG. 5C, capable of holding above mentioned remembrances, so they can then be placed on a chain, necklace, or charm bracelet in a free moving manner, or be used as a main component of rosary beads. These are just a few of its potential uses, but in no way limiting its future possibilities.

In one example, the adaptable/adjustable jewelry container of the present invention is comprised of a bezel designed base 12, which possesses a larger top opening with thinner side walls 6 and extends down and stops, to create a ledge 7 within the base 12. The bottom walls of base 12 is thicker than top walls forming the chamber 8, and the opening smaller, so there can be no mistake, no matter what shape or size of the adaptable/adjustable jewelry container, which is top or bottom of base 12. The base 12 will be sealed with solid end caps with an appropriate thickness to allow for setting of stones, engraving or other means of ornamentating its surface. The top cap 14 will be larger by design, and to fit snugly to inside bezel dimensions and be of such thickness to meet or extend slightly above the lip of bezel wall 6. In most but not all cases, the top cap 14 will be secured to the base 12 first, so that any adjustments in height FIG. 2A, FIG. 2B, can be made before one of the above mentioned materials are placed in chamber 8. The bottom cap 16 will be made the same thickness, although smaller in size so that it can snugly slip inside to adjust the height of container. The seal created by the same shape end caps will provide an airtight seal. The final step to assure a safe and reliable seal will be attained with laser or conventional soldering, or depending on materials used to create the container, an appropriate adhesive agent. These end caps in certain shapes, such as but not limited to, oval, round and square, may be replaced with a religious or common charm, to secure one or both ends.

The adaptable/adjustable jewelry container will generally but not necessarily be produced in metals related to the jewelry industry, such as but not limited to, all colors and karat weight of gold, silver and platinum. In the gift line area of production, the adaptable jewelry container might be made in brass, stainless steel, titanium, plastics, resins, and a variety of woods.

In certain cases to either mass produce or create a cleaner surface for the containers' overall appearance, either top cap 14 or bottom cap 16 may be pre-assembled or molded to its corresponding base 12. While the end cap remaining will be used to secure the chamber once cremated ashes, DNA, or other material is placed within the chamber 8 of the container.

The description herein refers to possible variations of this new invention for an adaptable/adaptable jewelry container, and is in no way to be seen or to be limited to these described examples. The examples are illustrated to show the unique and varied ways for this inventions practical uses within the context of the jewelry industry and the users needs to contain a treasured remembrance of something or someone of significance in their life.

BRIEF DESCRIPTION OF THE DRAWINGS

Other features, advantages and benefits of the present invention will become readily apparent from the following description taken in conjunction with the drawings wherein.

DESCRIPTION

The adjustable/adaptable jewelry container was invented to preserve the memory of a special moment, such as but not limited to, the sand from the beach in St. Thomas, where a couple was married, or the soil from the footprint of the twin towers, or a plot where a loved one was buried, or the cremated ashes or DNA of a cherished pet or family member. It can also be attached to a special charm given by the deceased, or added to any other item which creates a bond between the contents of the container and the owner.

Figure 4A:
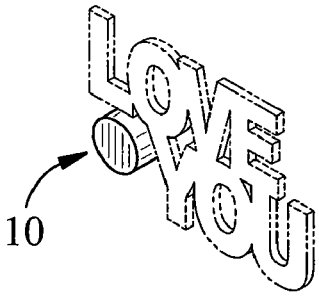
FIGS. 4A, 4B and 4C illustrates some examples 4A of a written "Love You", 4B Heart Charm, 4C Rabbit Charm, and how the adjustable/adaptable jewelry container 10 of the present invention may be used to accent and enhance a separate piece of jewelry. Although these illustrations show only one of many positions the container 10 may be placed.
Figure 4B:
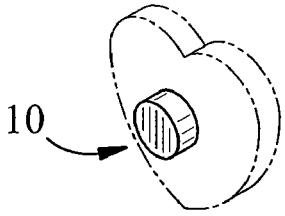

The present invention is a design for a three-part adaptable and adjustable jewelry container where two or more parts will be used to complete the container, and allow the cremated human, animal, or other species ashes, DNA material or soil to be placed within an airtight apparatus. The completed container 10 will then be attached to another piece of jewelry or giftware. Whether in plain frontal visual sight, as in but not limited to, a written "someone special" or "I love you" charm FIG. 4A, or in some instances may be attached on top of a heart, cross, or calendar charm while in other cases may be soldered and affixed to the back of almost any open backed charm FIG. 4B common in the jewelry industry.

Figure 5A:
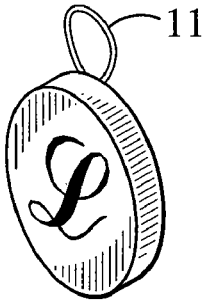
FIGS. 5A, 5B and 5C are examples of how the adaptable jewelry container 10 with the modification of adding a loop 11 in center of base, and increasing its size, can act as an independent piece of jewelry.
Figure 5B:
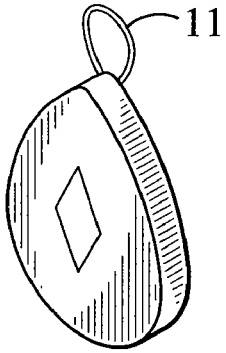
Figure 5C:
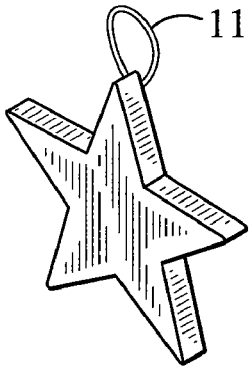
Figure 7:
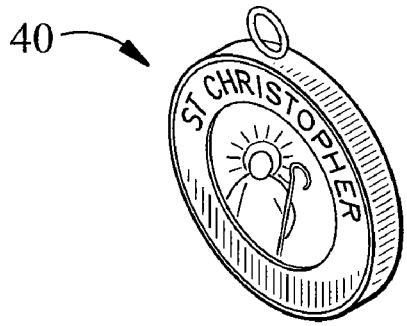
FIG. 7 shows how a religious medal, or other similar shaped designed top, with marking significant to user, in this case but not limited to, round or oval, could be used to replace top cap 14.

The adaptable/adjustable jewelry container will also function independently when completed in various shapes and sizes known to be common in the jewelry industry, some of which shapes are, but not limited to, round FIG. 7, oval FIG. 5A, pear shape FIG. 5B, marquise, square, star FIG. 5C and heart designs, which may be modified with a loop/jump rings 11 attached to the container, so that a bail for necklaces and pendants, or another loop/jump ring, will allow the adaptable/adjustable jewelry container to be placed onto a bracelet of various styles know in the jewelry industry. Ornamental designs maybe placed onto both the bottom and top caps. Engraving of initials, FIG. 5A and dates, as well as symbols such as eternity, infinity, cross or hearts will also be possible with this design. It is also contemplated that diamonds and other stones can be set into both the bottom cap 16 and top cap 14.

Figure 1:
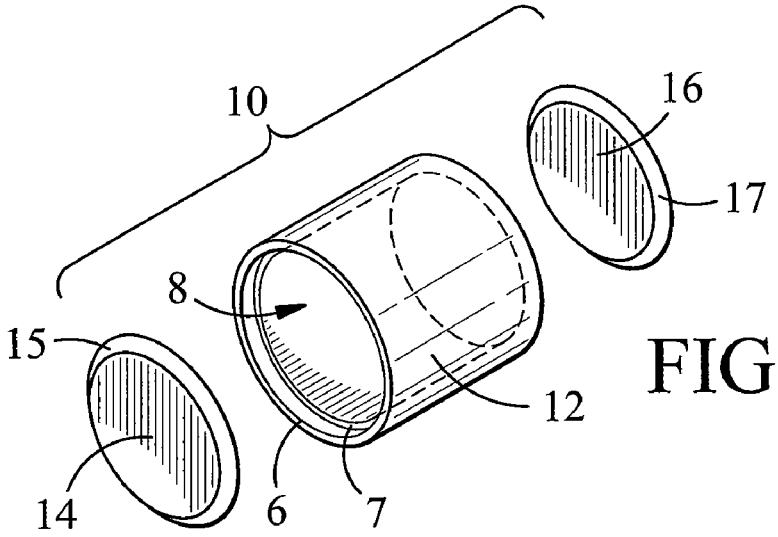
FIG. 1 is a exploded view showing the three parts that comprise the adaptable/adjustable jewelry container 10 in its round shape which may be made in various sizes, 2 mm and larger. The top cap 14 (reversed to show tapering 15) which is slightly smaller at bottom, so that it fits snugly when resting on the ledge 7. The bottom cap 16 which is smaller in size than top cap 14 is made in this manner to accommodate the thicker bottom walls, which extend from the ledge 7 to the end of the base 12.
Figure 2A:
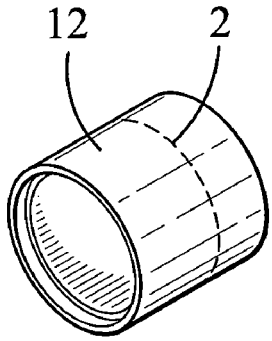
FIGS. 2A and 2B shows the bottom of side view of base 12, broken lines 2 to illustrate one of many possible positions where the base can be adjusted in height and cavity size to better adapt to its environment.
Figure 2B:
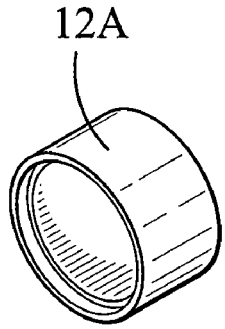

In an illustrative example the present invention uses three pieces FIG. 1 to construct an adaptable/adjustable jewelry container which will adjust by means of size, shape and height FIG. 2A to FIG. 2B and be used to store the cremated ashes or DNA of either human, animal or other species, as well as soil or sand, in a sealed airtight manner which will protect the enclosed sentimental material. Once the container is complete 10, it will be attached to another independent piece of jewelry or giftware.

The container's main component is comprised of a base 12, which has a bezel design top, which by nature in the jewelry industry is recessed with a larger opening 6 to allow for the top cap 14 to sink down and be held by the ledge 7. The bottom and corresponding opposite end of the base, has a smaller opening, with thicker walls which match the overall dimensions of the chamber 8, which starts at the ledge 7. This feature will permit the base to be modified in height before the container is closed and secured with bottom cap 16.

The top cap 14 will be larger than the bottom cap 16 because of the opening on the bezel end of base will have thinner inside walls 6, with a larger circumference. The top cap 14 will be made thick enough, to at least reach the top of the bezel end side walls 6, or to slightly extend past said wall. The top cap 14 and bezel end of base will then be secured by either soldering or adhesive, depending on the material which ultimately identifies the jewelry container. These two pieces will create a single chamber 8 or storage unit. When using most metals know to man, this process will be done by means in the jewelry industry associated with soldering, both laser and conventional. When the container is produced from plastics, wood or some other material not previously mentioned, the procedure of securing the top cap 14 and bottom cap 16 will be attained by means of a suitable adhesive to carry out the intended function.

Figure 6:
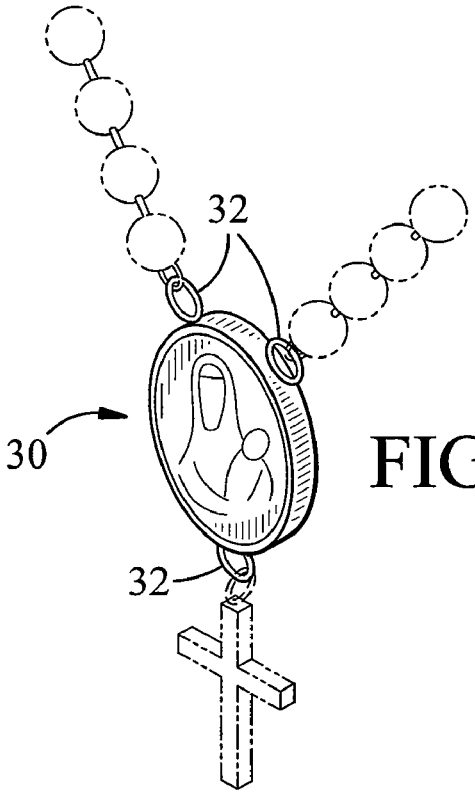
FIG. 6 shows an example of how by adding three loops, one bottom center 32, and two top 32 and equally apart on the base 12, the design will mimic the intersected ornamental bottom of a set of rosary beads that connects the beads to the cross.

Another example of this invention will have both ends of the base container mirror the opening of its opposite end and which will incorporate the larger bezel design features at both ends of the base or the smaller bottom. In this example the two caps will be the same size. This variation of the invention will allow for the front and back caps to be replaced with ornamental caps FIG. 6 and FIG. 7, which may include, but not restricted to, a different religious saint or symbol at each end of the base, so the symmetry of the two caps would visually be more esthetic when made in the same size.

The top cap 14 and the bottom cap 16, no matter their size, along with the base 12, in examples stated above, will create a single chamber or storage unit. When using most metals known to man, this process will be done by means in the jewelry industry associated with soldering, both laser and conventional. When the container is produced with materials which cannot be subjected to heat, such as but not limited too, plastics, wood or glass, the procedure of securing the top cap 14 and bottom cap 16 will be attained by means of a reliable adhesive. Adhesive will also be used in examples when sample in containers is sensitive to heat, or if being assembled for immediate use or delivery.

Figure 3A:
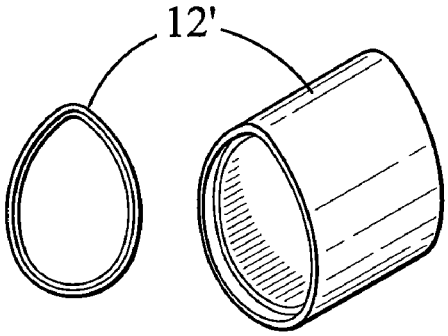
FIGS. 3A and 3B shows examples of possible other shapes 12', 12" the container may assume such as, oval and pear shape, but not limited to these only.
Figure 3B:
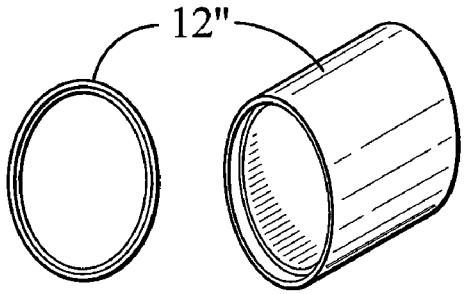

The top cap 14 and bottom cap 16 will match the shape of the base unit FIG. 3A, FIG. 3B, FIG. 5C and will fit with minimal to maximum resistance into their respective openings. In one example of the invention the top cap 14 and bottom cap 16 will form a seal without the use of solder or adhesive into their respective openings, by tapering the edge of one side of the top cap 14 and bottom cap 16 (FIG. 1) to form a variation of a compression fit, so that when tapped by a hammer or pressed with some force will secure contents before final phase of closure is completed.

Figure 4C:
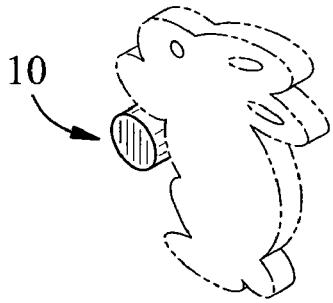
Figure 9:
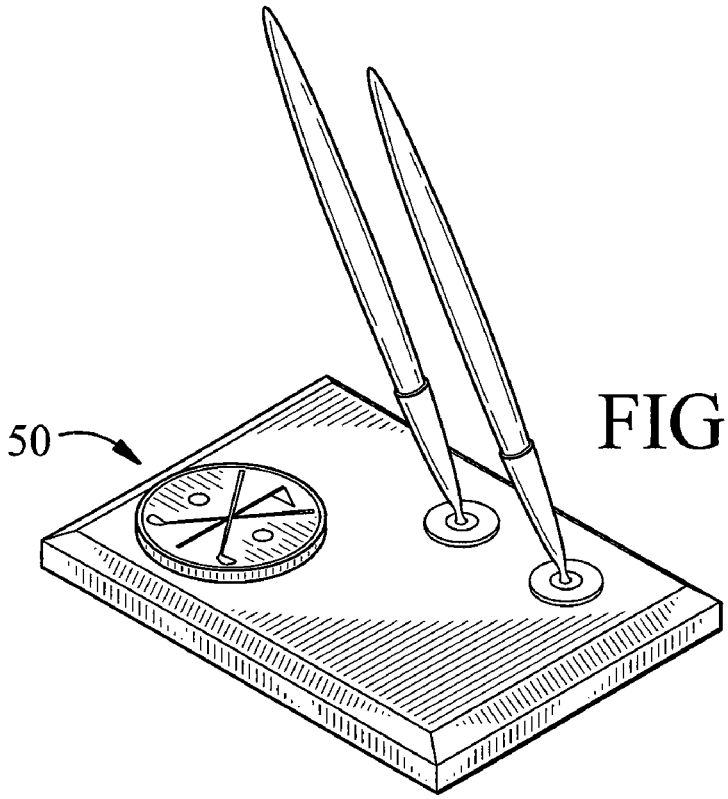
FIG. 9 shows a wooden paperweight and pen set with a golf motif, adapted to hold the design for an adjustable/adaptable jewelry container of the present invention, by sinking the container 50 into the wooden base.
Figure 12:
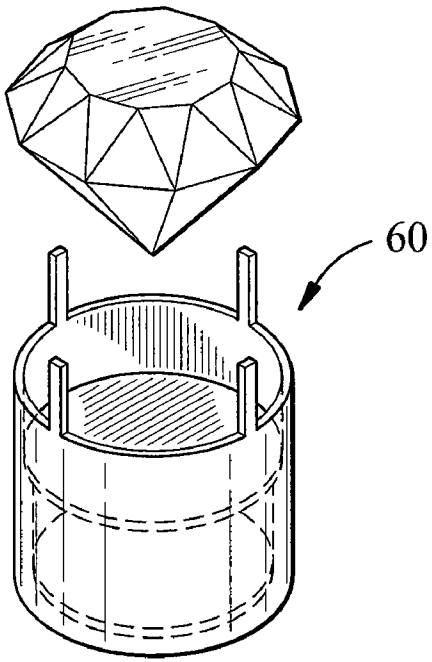
FIG. 12 illustrates an example of how the container 10 can be placed and attached to traditional basket settings of different shapes and dimensions.
Figure 11:
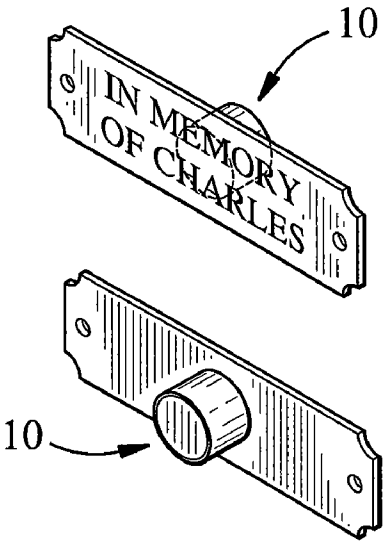
FIG. 11 shows an alternate way of attaching the container 10, first onto a plate that can be engraved, then placed onto picture frame or plaque after drilling a hole into material the same size as container 10.
Figure 10:
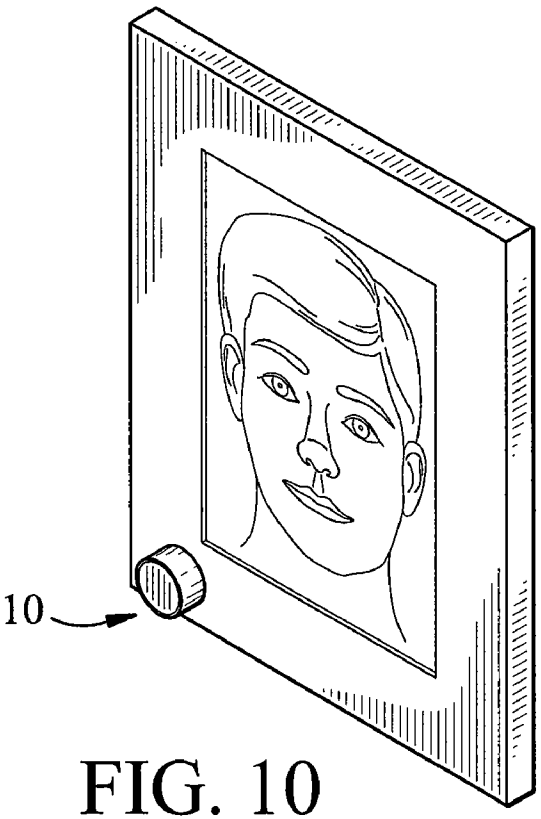
FIG. 10 shows how a simple picture frame may be modified to hold adjustable/adaptable jewelry container 10 of the present invention.

The bottom or non-bezel portion of the base 12 will be adjusted in height FIG. 2A, FIG. 2B by means of cutting with a saw blade, filing, or using grinding wheel or other suitable means. The forming of this design feature does not need to be to perfect, as any uneven excess metal or material will be removed after the chamber 8 is filled and the smaller base cap 16 is secured by means of above stated methods of closure. The completed container 10 will then be attached or placed onto another item of jewelry FIG. 4A, FIG. 4B, FIG. 4C or giftware FIG. 9 and FIG. 10 to give the appearance of a new unique piece of jewelry. The adaptable/adjustable jewelry container will in most cases when using metals, be attached by means of laser or conventional soldering, someplace on, behind or around edges of converted jewelry.

The flexibility of this container, is depending on its size and shape, such that it can be incorporated to appear as if it is an extension of the original piece of jewelry, or hidden behind the exposed backside of most charms, and rings, or on top of bracelets and in front, sides or back of pendants.

The adaptable/adjustable jewelry container may be made in sizes and shapes that are common in the jewelry industry. Although a round container is discussed above, it is in no way limited to such a shape restriction. The round adjustable jewelry container will have the versatility to be made in sizes from 2 mm to 70 mm or larger. It will also be made in oval, marquise, pear shape, square, emerald, star and heart shape, as well as other shapes not mentioned but deemed recognizable in the jewelry industry. These different shapes will also be made in various sizes, and will conform to the same parameters as stated above whereby the shapes will possess a base 12, 12' 12" with a top bezel design, which will accommodate a larger same shape top cap 14 and smaller same shape bottom cap 16, so that the height can still be adjusted to suit the independent piece. These different shapes will include but not be limited to, the standard dimensions found to be common in the jewelry industry.

The adaptable/adjustable jewelry container 10 as discussed above, should be arranged to have a top cap 14 and bottom cap 16 of different dimensions, and be made thick enough to accommodate the addition of diamonds, other stones, deep engraving, creative designs, such as an infinity, eternity, cross, or heart, but not solely restricted to these designs. The top cap 14 and bottom cap 16 may also be substituted with a conventional religious FIG. 7 or specialty charm (FIG. 9) 50 that conforms to the dimensions and parameters of its corresponding base.

In another example, the adaptable/adjustable jewelry container of the present invention can also function independently when completed in larger sizes FIG. 5A, FIG. 5B, FIG. 5C, and FIG. 7, to form its own identity. Depending on the shape and size of the container 10, and the addition of one or more loops 11 or bale, the container can swing freely on a chain or charm bracelet. While with the modification of three loop/jump rings 32, two placed evenly apart at top of oval or other shaped design and one center bottom, the adaptable/adjustable jewelry container will form the focal point of a line of rosary beads FIG. 6 whereby the top or bottom end caps may be replaced with religious medals or other ornamentation. These examples are not to be taken as the only modifications of the basic design which would create new versatile lines of jewelry.

Figure 8A:
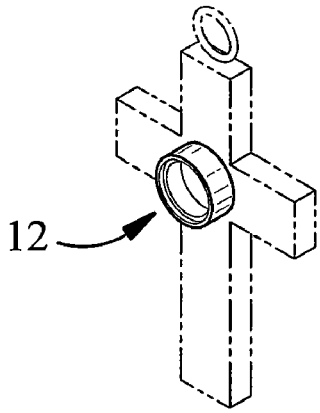
FIGS. 8A, 8B and 8C shows examples of possible designs which will include two of the pieces of jewelry container comprising of the base 12 and either bottom cap 16, or top cap 14, already attached to jewelry, so that only top or bottom cap will be needed to seal container in manufacturing. This does not in any way reflect the full scope of line being created, or limit the rights and ability to use other shapes as possible replacements for round design shown attached.
Figure 8B:
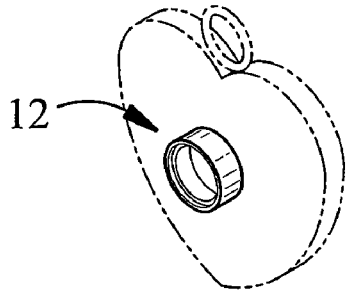
Figure 8C:
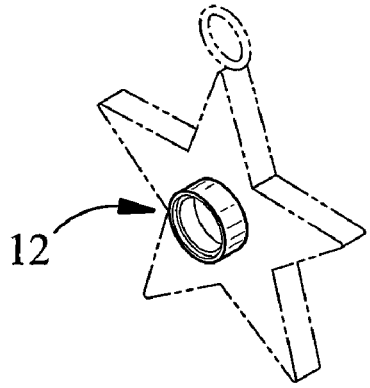

When the adaptable/adjustable jewelry container is being used in an exclusive line of jewelry, such as, but not limited to, crosses, hearts, stars, animals, written charms, or regular charms symbolizing sea, plant, islands or other locations or sports, the base 12 with smaller bottom opening closed with bottom cap 16, will be incorporated into the mold or die cast to make it easier and neater to manufacture jewelry with the partial container already placed in its desired location. FIG. 8A, FIG. 8B, FIG. 8C During this method of assembly, the top cap 14 will be secured after the material, whether cremated ashes, DNA, soil or other earthly materials such as sand, are placed in the open chamber 8.

The adaptable/adjustable jewelry container can be manufactured in any metal, such as but not limited to, all colors and karat weight of gold, silver or platinum, as well as brass or stainless steel and titanium. It may also be manufactured in all colors and types of plastics and resin products, as well as different types of wood.

When the adaptable jewelry container is produced in wood, plastics or some other unmentioned material, the top cap 14 and bottom cap 16 will be sealed with a premium adhesive to secure the enclosed material in the container's chamber 8. Some, but not limited to, uses for this type of assembly will be when incorporating this design in plaques, trophies, frames, paperweights, and costume jewelry. The adjustment in the depth of the cavity at the smaller bottom will still be possible in these materials.

There may be times during manufacturing large quantities, where either the top cap 14 or bottom cap 16 will be pre-assembled or molded to its base counterpart for purposes of efficiency and to produce a cleaner product.

It is to be understood that the above-described arrangements are only illustrative of the application of the principles of the present invention and are not to be construed as limitations of the invention. Numerous modifications and alternative arrangements may be devised by those skilled in the art without departing from the scope of the invention and the appended claims are intended to cover such modifications and arrangements. Further, the invention contemplates all embodiments that may be inferred directly or indirectly from the disclosure and drawings whether or not expressly stated and claimed.

The invention claimed is:

1. An adaptable/adjustable jewelry container comprising:

a base component configured with a bezel design top at one end of said base component and an oppositely disposed bottom end and a wall thickness defining an inner cavity there between;

a top cap;

a bottom cap;

said bezel design top further configured with a recessed opening dimensioned for snuggly receiving said top cap in said recessed opening, and having a thinner wall thickness in the region of the recessed opening to form an internal peripheral ledge;

said bottom end of said base component configured with an opening smaller than said bezel design top recessed opening and dimensioned for snuggly receiving said bottom cap in said base component bottom end opening;

said adaptable/adjustable jewelry container defining a single chamber storage unit in response to said top cap being positioned in said bezel design top and said bottom cap being positioned in said bottom end of said base component.

2. The adaptable/adjustable jewelry container as defined in claim 1 wherein the cross-section dimension of said top cap is larger than the cross-section dimension of said bottom cap.

3. The adaptable/adjustable jewelry container as defined in claim 2 wherein said top cap is secured in position by soldering said top cap to said base component.

4. The adaptable/adjustable jewelry container as defined in claim 2 wherein said bottom cap is secured in position by soldering said bottom cap to said base component.

5. The adaptable/adjustable jewelry container as defined in claim 1 wherein the dimension of said base component end-to-end is selectable to a desired dimension in response to cutting said base component at said bottom end to said desired dimension.

6. The adaptable/adjustable jewelry container as defined in claim 1 further comprising a cylindrical base component shape.

7. The adaptable/adjustable jewelry container as defined in claim 6 wherein the end-to-end dimension between said bezel top end and said bottom end is in the range of 2 millimeter to 70 millimeters.

8. The adaptable/adjustable jewelry container as defined in claim 6 wherein the end-to-end dimension between said bezel top end and said bottom end is greater than 70 millimeters.

9. The adaptable/adjustable jewelry container as defined in claim 1 made of a suitable material including metal, wood and plastic.

10. The adaptable/adjustable jewelry container as defined in claim 1 further comprising attaching at least one loop or bale to the container to configure it to swing on a chain or bracelet.

11. The adaptable/adjustable jewelry container as defined in claim 1 further configured to store a desired remembrance material.

12. The adaptable/adjustable jewelry container as defined in claim 11 wherein the remembrance material is DNA.

13. The adaptable/adjustable jewelry container as defined in claim 11 wherein the remembrance material is cremation ashes.

14. The adaptable/adjustable jewelry container as defined in claim 1 wherein said base component is configured in a desired geometrical shape.

15. An adaptable/adjustable jewelry container comprising:

a base component configured with a bezel design top at one end of said base component and an oppositely disposed bottom end and a wall thickness defining an inner cavity there between;

a top cap;

a bottom cap;

said top cap having a cross-section dimension larger than the cross-section dimension of said bottom cap;

said bezel design top further configured with a recessed opening dimensioned for receiving said top cap, and having a thinner wall thickness in the region of the recessed opening to form an internal peripheral ledge wherein said top cap is secured in position by soldering said top cap to said base component;

said bottom end of said base component configured with an opening smaller than said bezel design top recessed opening and dimensioned for receiving said bottom cap wherein said bottom cap is secured in position by soldering said bottom cap to said base component; and said adaptable/adjustable jewelry container defining a single chamber storage unit in response to said top cap being positioned in said bezel design top and said bottom cap being positioned in said bottom end of said base component.

* * * * *